US006398603B1

(12) United States Patent
Brown

(10) Patent No.: US 6,398,603 B1
(45) Date of Patent: Jun. 4, 2002

(54) AQUATIC PROPULSION DEVICE

(76) Inventor: William Blake Brown, 218 Jo Dr., Los Gatos, CA (US) 95032

( * ) Notice: Subject to any disclaimer, the term of this patent is extended or adjusted under 35 U.S.C. 154(b) by 0 days.

(21) Appl. No.: 09/709,186

(22) Filed: Nov. 8, 2000

(51) Int. Cl.[7] ..... A63B 31/10
(52) U.S. Cl. ..... 441/56; 441/59; 440/101
(58) Field of Search ..... 441/55–59; D21/806, D21/807, 678; 416/63, 69, 70 R; 440/101, 104, 102

(56) References Cited

U.S. PATENT DOCUMENTS

| | | | | | |
|---|---|---|---|---|---|
| 545,706 | A | * | 9/1895 | Mannes | 416/63 |
| 1,821,974 | A | * | 9/1931 | Leblanc | 441/59 |
| 2,188,343 | A | * | 1/1940 | Flournoy | 416/63 |
| 2,771,618 | A | | 11/1956 | Crum | |
| 2,893,021 | A | * | 7/1959 | Lundborg | 416/63 |
| 3,039,120 | A | * | 6/1962 | Powell et al. | 416/63 |
| 3,109,184 | A | * | 11/1963 | Moore, Jr. | 416/63 |
| 3,153,797 | A | * | 10/1964 | Drennen, Jr. | 416/63 |
| 3,286,287 | A | | 11/1966 | Martin | |
| 3,407,419 | A | * | 10/1968 | Drummond | 441/56 |
| 3,518,024 | A | * | 6/1970 | Wilson | 441/76 |
| 3,786,526 | A | | 1/1974 | Ausseil | |
| 3,913,907 | A | | 10/1975 | Baker | |
| 3,922,740 | A | | 12/1975 | Potter | |
| 4,129,912 | A | * | 12/1978 | Robinson | 416/63 |
| 4,509,744 | A | | 4/1985 | Beasley | |
| 4,521,011 | A | | 6/1985 | Solloway | |
| 4,913,418 | A | | 4/1990 | Schlueter | |
| 5,288,254 | A | | 2/1994 | Elson | |
| 5,378,217 | A | * | 1/1995 | D'Orta | 482/111 |
| 5,658,224 | A | | 8/1997 | Betrock | |
| 5,795,201 | A | * | 8/1998 | Tibbetts | 440/101 |
| 5,842,896 | A | * | 12/1998 | Liveoak | 441/56 |

FOREIGN PATENT DOCUMENTS

| | | | | |
|---|---|---|---|---|
| GB | 640355 | * | 7/1950 | 441/58 |
| IT | 410205 | * | 4/1947 | 441/55 |

* cited by examiner

*Primary Examiner*—S. Joseph Morano
*Assistant Examiner*—Ajay Vasudeva

(57) ABSTRACT

An aquatic propulsion device includes an elongate member secured to a forearm support and a paddle. The paddle and elongate member include a grip positioned such that a person may place their forearm in the forearm support and reach and hold onto the grip. While wearing the aquatic propulsion device, the person may perform power and/or return strokes using their forearm and hand, such that the forearm support, the elongate member, and the paddle move in tandem with the forearm and hand. The aquatic propulsion device is characterized by a center of water displacement that extends beyond the hand, away from the forearm. Additionally, a leading edge of the paddle is substantially inline with the hand and forearm.

17 Claims, 13 Drawing Sheets

AQUATIC PROPULSION DEVICE

FIELD OF INVENTION

This invention relates to; human powered devices for enhancing propulsion in, through, or upon water.

BACKGROUND

Human powered aquatic propulsion devices are often used for purposes of sport, recreation, exercise, training, rescue, and/or rehabilitation. Aquatic propulsion devices exist in different configurations, some of which rely primarily upon lower body strength and others that primarily rely upon upper body strength. Aquatic propulsion devices that rely upon upper body strength frequently utilize hand paddles as a propulsion enhancement mechanism. Examples of aquatic propulsion devices utilizing hand paddles are given in U.S. Patent Nos. 3,913,907; 3,922,740; 5,658,224; 5,288,254, and 4,913,418. Some aquatic propulsion devices utilize paddles or fins attached to a forearm, such as those described in U.S. Patent Nos. 4,521,011 and 3,786,526.

Hand paddles enhance aquatic propulsion by displacing a greater amount of water for a given movement than would result from hand movement alone. Aquatic propulsion may also be enhanced through the leveraging of force over a distance greater than that defined by a human limb movement alone. As an example, the use of oars for rowing boats leverages force over distance, thereby increasing the efficiency of human work. Unfortunately, the hand and/or forearm paddles mentioned above fail to incorporate useful leveraging action. Such hand and/or forearm paddles may be characterized as providing a water displacement distance that is the same as or less than the movement of a hand, thereby undesirably limiting the extent to which they may enhance aquatic propulsion.

A hand paddle disclosed in U.S. Patent No. 4,509,744 extends a center of displacement slightly beyond a hand, directly away from an arm. However, this invention is designed only as an exercise device to be utilized against the resistance of water. Due to design shortcomings, this and similar types of inventions would be of limited use relative to enhancing aquatic propulsion.

The torque generated by water resistance at the center of displacement and the force applied by a hand increase linearly with the distance between the center of displacement and the hand. This force must be countered by an equal but opposite force to keep a paddle substantially in plane with the hand and arm.

U.S. Patent No. 4,509,744 discloses a hand paddle that uses a wrist guide, which reduces the turning moment about a user's wrist. Because of the proximity of the wrist to the hand relative to the distance from the hand to the center of water displacement, leveraged forces can become very great at the wrist. A wrist is typically bony and uneven on its top side, while its underside is soft, having many unprotected moving tendons. Thus, the wrist is not suitable for countering torque generated by an extended center of water displacement. The hand paddle design disclosed in U.S. Patent No. 4,509,744 is therefore problematic relative to the stresses imposed upon a user's wrist.

A paddle may be defined as having a leading edge, which is the edge that first 'cuts' though the water on the return or non-power stroke during swimming. As the perpendicular distance of a paddle's leading edge relative to a hand or arm increases, the paddle's steering radius undesirably increases, and a user's margin for error and ability to perform directional adjustments decrease. This effect is similar to using the rear wheels of a car for steering. Unfortunately, prior hand and arm paddles fail to properly position the leading edge of the paddle relative to a user's arm or hand, thereby limiting their ease of use and effectiveness.

In addition to the aforementioned problems, the. enhanced water displacement of hand and arm paddles can be disadvantageous or dangerous when hands and arms need to be used for actions other than swimming, for example, when taking pictures, picking up objects, or adjusting, scuba or snorkeling apparatus. Removal of prior art hand and/or arm paddle assemblies can be problematic since such assemblies encumber both hands and arms.

SUMMARY OF THE INVENTION

According to one aspect of the invention, an aquatic propulsion device comprises a forearm support to be worn on a forearm of a person; an elongate member having a first end secured to the forearm support; and a paddle secured to a second end of the elongate member. A combination of the elongate member and the paddle include a grip positioned so that a person, when placing their forearm in the forearm support, may reach and hold onto the grip with a hand. The person may move the grip with the hand such that the forearm support, the elongate member and the paddle move in tandem with the hand and the forearm. A combination of the forearm support, the elongate member, the grip, and the paddle is characterized by a center of water displacement extending beyond the hand, away from the forearm.

Extending the distance between the center of water displacement and the grip directly away from the hand and forearm advantageously enhances aquatic propulsion by leveraging force over a distance or arc length greater than that defined by hand movement alone. A constraining action between the forearm support against or upon the forearm may counter a rotational moment of the paddle about the grip. The distance between the grip and the forearm support, through leveraging, significantly reduces the force required to counter the rotational moment of the paddle about the grip relative to a force that would otherwise be required proximate the hand or wrist.

Another aspect of the invention teaches that a leading edge of the paddle is substantially inline with the hand and forearm, thereby enhancing a user's ability to perform directional adjustments. For safety and convenience, in an additional aspect of the invention, the forearm support partially encloses the forearm, such that release of the hand grip facilitates essentially free release of the aquatic propulsion device from the person.

DETAILED DESCRIPTION

Figure 1:
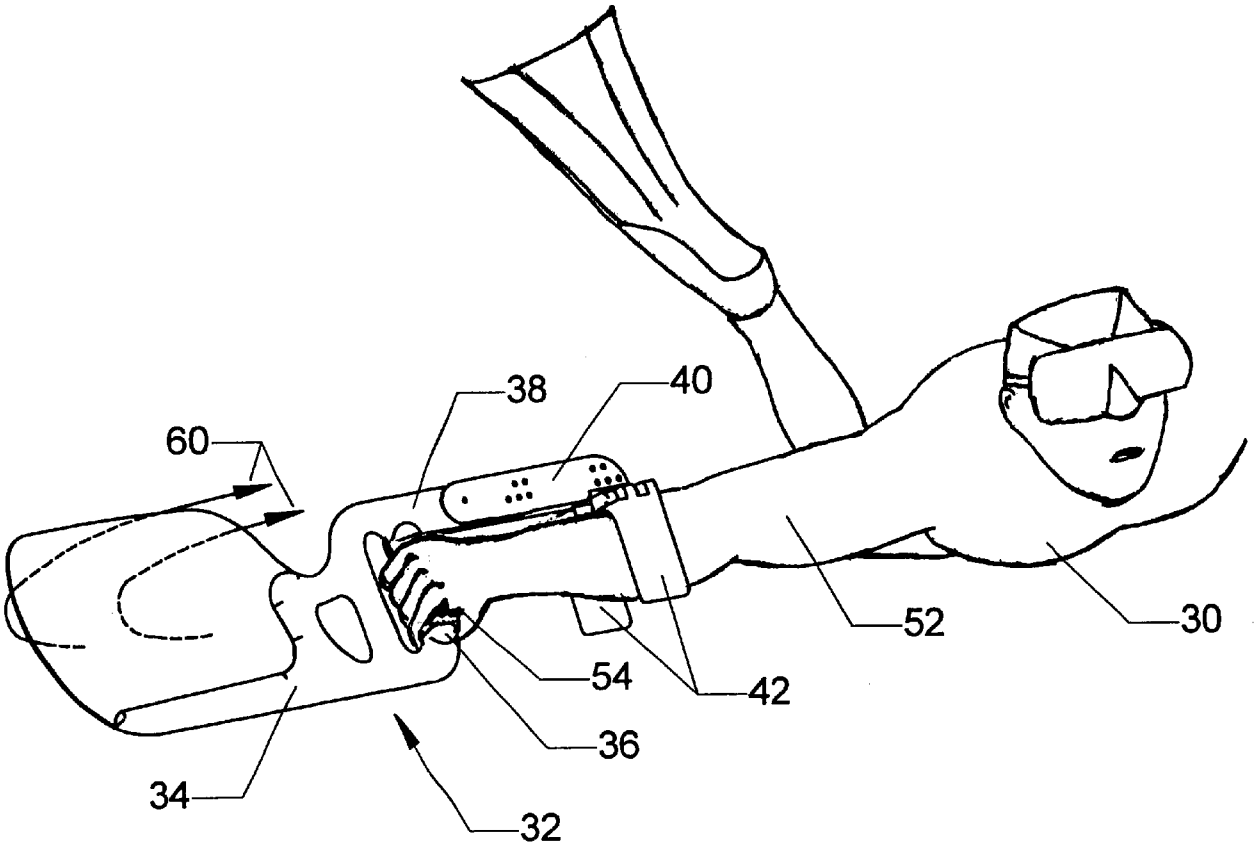
FIG. 1 is a drawing illustrating a diver using an aquatic propulsion device constructed in accordance with the present invention.

FIG. 1 of the accompanying drawings illustrates a person 30 using an aquatic propulsion device 32 according to an embodiment of the invention. The aquatic propulsion device 32 comprises a paddle 34, a hand grip 36, a forearm-member mount 38, an elongated forearm member 40, and a forearm support 42. In use, the person 30 inserts an arm 52 into the forearm support 42, and uses a hand 54 to hold or grasp the hand grip 36. The person 30 alternately employs or performs propulsive, or power, strokes, followed by return, or non-power, strokes with the present invention to propel themselves through water.

Relative to propulsive strokes, movement of the arm 52 and hand 54 along the general direction of a propulsive axis, arc, or travel path 60 applies a force to the hand grip 36. This force in turn causes the paddle 34, which is oriented or held generally perpendicular to the propulsive axis 60 during the propulsive stroke, to displace a significant amount of water along the direction of the axis 60, thereby propelling the person 30 forward. The person 30 may adjust the particular orientation of the axis 60 by rotating their arm 52 and hand 54, which in turn may adjust the direction of propulsion during use.

Relative to return strokes, movement of the arm 52 and hand 54 along a return path (not shown) such that the paddle 34 is held or oriented generally parallel to the return path to minimize the amount of water displaced by the aquatic propulsion device 32 effectively returns the aquatic propulsion device 32 to a position from which another power stroke may originate. Those skilled in the art will understand that a return stroke may generally retrace some or all of a power stroke, and that a return stroke may be used to reorient the aquatic propulsion device 32 to a new position prior to a power stroke.

Figure 2:
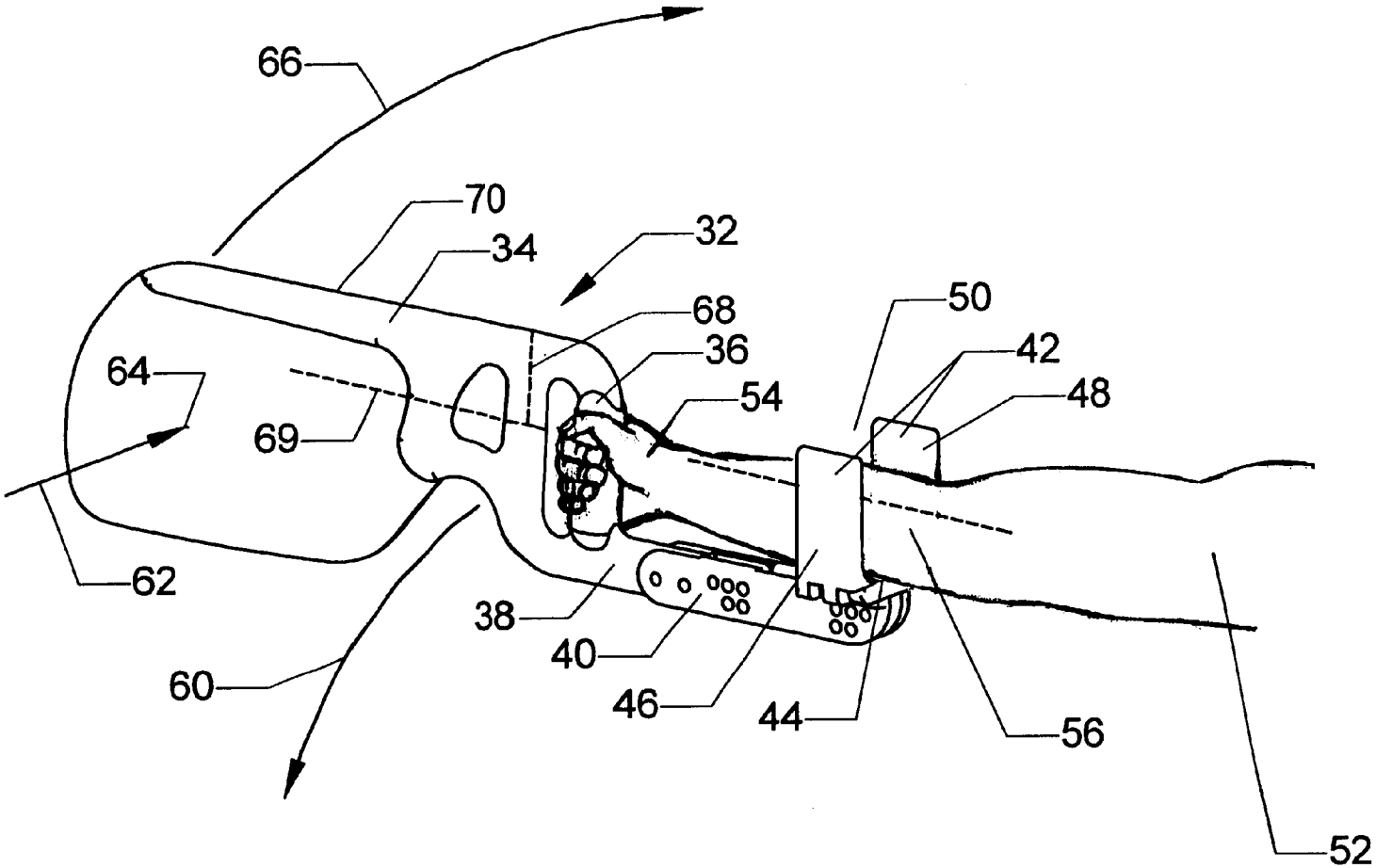
FIG. 2 is a perspective view showing a user's arm position while holding an aquatic propulsion device constructed in accordance with the present invention.

Referring also now to FIG. 2, a perspective view shows an aquatic propulsion device 32 supporting a user's arm 52. The forearm support 42 may be generally u-shaped, and includes a support bottom 44, a support front 46, a support back 48 and a support opening 50. The support bottom 44 is secured to the elongated forearm member 40, and the support front 46 and support back 48 are secured to the support bottom 44. Depending upon particular embodiment details, the support front 46 and/or the support back 48 may form a single, integral unit with the support bottom 44. The support opening 50 is formed by a space between the support bottom 44, the support front 46 and the support back 48. A person 30 using the present invention inserts a forearm 56 into the support opening 50, such that the forearm 56 is positioned against or upon the support bottom 44,;the support front 46, and the support back 48.

Opposing ends of the hand grip 36 are secured to the paddle 34. One end of the forearm member mount 38 is secured to the paddle 34, and an opposing end of the forearm member mount 38 is secured to one end of the elongated forearm member 40. In response to a person's hand 54 applying a force against the hand grip 36 along the axis 60, water resists the movement of the paddle 34 and creates a resistive force 62. The resistive force 62 may be effectively characterized by a resistive center 64. Increasing the distance between the resistive center 64 and the hand grip 36 directly away from the arm 52 advantageously enhances aquatic propulsion by leveraging force over a distance or arc length greater than that defined by hand movement alone. As an analogy, the use of paddles for rowing canoes leverages force over distance, thereby increasing the efficiency of human work. The present invention's leveraging of force significantly enhances a user's propulsion through water relative to prior types of devices such as conventional hand paddles.

The resistive force 62 at the resistive center 64 generates a rotational moment 66 about the hand grip 36. Those skilled in the art will understand that movement of the paddle 34 along or about the rotational moment 66 should generally be restricted or limited to maximize the amount of water the paddle 34 displaces.

Through the aforementioned leveraging action, the torque generated by the rotational moment 66 proximate the hand 54 may be quite significant, and thus the hand 54 alone may have difficulty countering the rotational moment 66. The present invention addresses this situation via the forearm support 42. In particular, the support back 48 provides a surface capable of bearing pressures applied by the forearm 56 to counter the rotational moment 66 around the hand grip 36. The distance between the hand grip 36 and the forearm support 42 reduces the leveraging action of the rotational moment 66 proportional to the distance between the hand grip 36 and the resistive center 64. Therefore, the force applied by the support back 48 against the forearm 56 is significantly reduced relative to a force that would otherwise be required proximate the hand 54 or wrist. Moreover, a person's forearm 56 tends to be muscular, and can therefore more easily and comfortably bear the force applied by the support back 48. One skilled in the art will recognize that movement of the arm 52 and the hand 54 opposite to the axis 60 results in the generation of oppositely-directed forces that can be countered to the same effect and advantage by the forearm 56 against the support front 46 of the forearm support 42.

At times, a person's arms 52 and hands 54 may be required for actions other than aquatic propulsion, for example, taking pictures, picking up objects, and/or adjusting scuba or snorkeling gear. In one embodiment, by simply releasing the hand grip 36, the resistive effect of water and/or gravitational forces allow the user 30 to freely remove their arm 52 and hand 54 from the aquatic propulsion device 32. The present invention may advantageously provide simple, rapid, and unaided removal of the arm 52 and hand 54 to maximize both safety and convenience.

Figure 3:
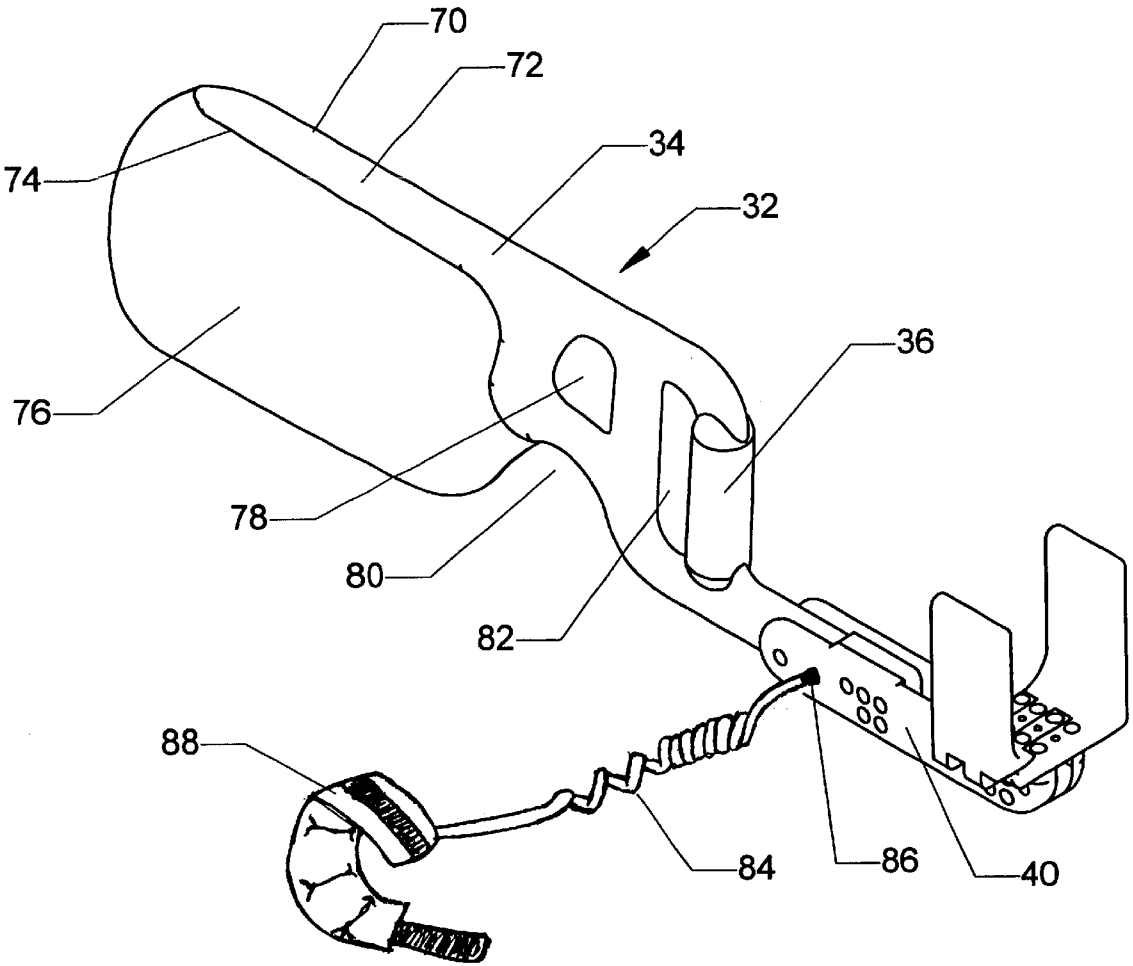
FIG. 3 is a perspective view of an aquatic propulsion device constructed in accordance with the present invention.

Referring also now to FIG. 3, a perspective view shows additional details of an aquatic propulsion device 32 constructed in accordance with the present invention. The embodiment shown in FIG. 3, includes a tether 84, which may be employed to prevent the aquatic propulsion device 32 from drifting, floating, sinking or otherwise undesirably moving away when the person 30 releases or disengages their hand 54 and arm 52 from the aquatic propulsion device 32. The tether 84 may be added to or included in any particular embodiment of aquatic propulsion device 32. In one embodiment, a first end of the tether 84 may be secured to the elongated forearm member 40 using a tether pin 86. An opposing end of the tether 84 may be secured to an arm strap 88. The arm strap 88 may be secured as desired along the arm 52 using, for example, a Velcro strap, a buckle, or other attachment mechanism as would be well understood by one skilled in the art. In another embodiment, the tether 84 may be secured to the person 30 at a swimming suit, a waist belt, a diving vest, a life vest or a wet/dry suit using a Velcro strap, a buckle, a clip, a carabiner or other type of conventional attachment mechanism.

FIG. 3 additionally shows that the paddle 34 includes a leading edge 70; a rigidifying support 72 having a trailing side 74; a resistive surface 76; a spacing hole 78; a spacing recess 80; and a hand grip hole or opening 82. The rigidifying support 72 lies along or upon the paddle's leading edge 70. The resistive surface 76 may be secured to the paddle 34 along the rigidifying support's trailing side 74. Those of ordinary skill in the art will readily understand that the rigidifying support 72 and resistive surface 76 may be constructed in alternative shapes and designs, including variations in widths and lengths. Those skilled in the art will further understand that the rigidifying support 72 may be divided or "splayed out" into multiple generally-rigid members or "fingers" across the resistive surface 76, in a manner similar to the fingers or divisions found in a bat wing.

The spacing hole 78 and the spacing recess 80 may be cut, drilled, formed, or otherwise placed in the rigidifying support 72 proximate the hand grip 36 to focus water displacement on the resistive surface 76. This, in turn, moves the resistive center 64 further away from the hand grip 36, advantageously increasing the efficiency of aquatic propulsion. The hand grip hole 82 may be cut, drilled, formed or otherwise placed in the rigidifying support 72 to allow for comfortable and secure placement of the hand 54 around the hand grip 36.

The paddle's leading edge 70 may be defined as an edge or side that first 'cuts' or 'slices' through the water on a return or non-power stroke during swimming. Referring again to FIG. 2, the paddle 34 may be further characterized as having a steering radius 68, defined by a perpendicular distance from the leading edge 70 to a line 69 running through the hand 54 and the forearm 56. The present invention teaches that the leading edge 70 should be inline or generally proximate and parallel to the line 69 running through the hand 54 and the forearm 56. In other words, the steering radius 68 should not typically extend much past the hand 54, thereby enhancing a user's ability to perform directional adjustments. When the steering radius 68 is small, the effect is similar to steering an automobile with its front wheels; however, as the steering radius is extended, the effect is similar to steering an automobile with its rear wheels. The small steering radius 68 provided by the present invention advantageously aids user control, in contrast to prior types of devices directed toward enhancing human propulsion in water. In an exemplary embodiment, the steering radius is approximately three inches.

The hand grip 36, the forearm member mount 38, the elongated forearm member 40, the forearm support 42 and the rigidifying support 72 may be constructed using material that is rigid, strong, light weight, UV protected and corrosion resistant, as well as attractive and hydrodynamic. In some embodiments, it may be advantageous for the rigidifying support 72 to have some amount of flexibility in order redirect forces, channel water flow and relieve stress. Many conventional types of plastics, rubber, metal alloys or the like would be suitable for construction of the present invention. For example, High-Density Polyethylene (HDPE), Aluminum, Titanium, and/or Carbon fiber materials may be employed in construction of the present invention.

The resistive surface 76 may be constructed using material that is flexible, strong, light weight, UV protected and corrosion resistant, as well as attractive and hydrodynamic. Many conventional types of plastic, rubber, metal alloys or the like, would be suitable, including one or more of the aforementioned materials. The desired flexibility of the resistive surface 76 may depend on the particular application of the present invention, and may be determined by material type and/or material thickness. For example, a novice user 30 may desire greater flexibility to reduce fatigue, while a more experienced user 30 may want less flexibility for higher performance. The resistive surface 76 may be manufactured. from the same material as the rigidifying support 72, but typically manufactured thinner in order to provide a desired amount of flexibility. This allows the paddle 34 to be manufactured using a single injection molding process. The boundary between the rigidifying support 72 and the resistive surface 76 may be abrupt, or a gradual taper as best suits any given application. Alternatively, the resistive surface 76 may be constructed using a material different from that of rigidifying support 72, and laminated, bolted, welded, or otherwise secured to the rigidifying support 72.

The desired buoyancy or density of the material or materials used to manufacture the aquatic propulsion device 32 may be selected based upon application. For example, scuba and underwater applications may require materials characterized by neutral or slightly negative buoyancy, while snorkeling and surface water applications may find materials providing increased buoyancy advantageous.

As with many manufactured products, cost, manufacturability, and intended application relative to any given choice of materials must be considered. The aforementioned elements may be manufactured from conventional materials using conventional injection molding, machining and/or similar techniques.

Figure 4:
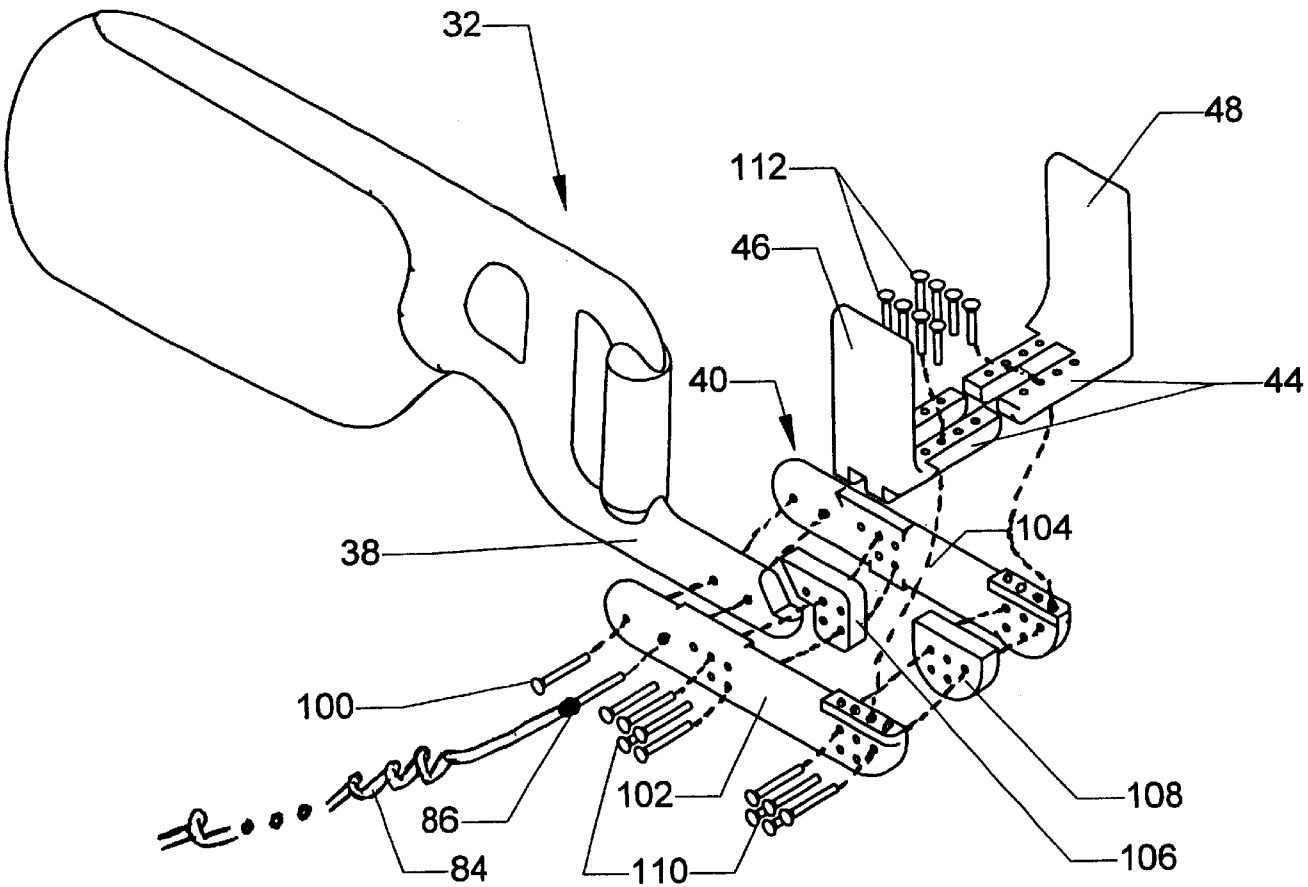
FIG. 4 is an exploded perspective view of an aquatic propulsion device constructed in accordance with the present invention.

FIG. 4 illustrates an exploded view of an aquatic propulsion device.32 constructed in accordance with the present invention. A rotational attachment screw 100 may be used to secure the forearm member mount 38 to the elongated forearm member 40. The tether pin 86 may also be used to further secure the forearm member mount 38 to the elongated forearm member 40, in addition to securing one end of the tether 84 to the aquatic propulsion device 32.

The elongated forearm member 40 comprises a front elongated member 102, a back elongated member 104, a rotational stop 106, a spacing component 108 and a set of forearm member screws 11 0. The forearm member screws 110 may be used to secure the front elongated member 102 to a first side of the rotational stop 106 and a first side of the spacing component 108. The forearm member screws 110 may continue through the rotational stop 106 and the spacing component 108, and may also be used to secure an opposing side of the rotational stop 106 and an opposing side of the spacing component 108 to the back elongated member 104. A set of forearm support screws 112 may be used to secure the support bottom 44 to the elongated forearm member 40, such that the support front 46 and the support back 48 are slidably adjustable to comfortably and securely fit the forearm 56. Those skilled in the art will recognize that various embodiments of the aquatic propulsion device 32 may rely upon additional, fewer, and/or different types of securing elements than those shown in FIG. 4.

Figure 5:
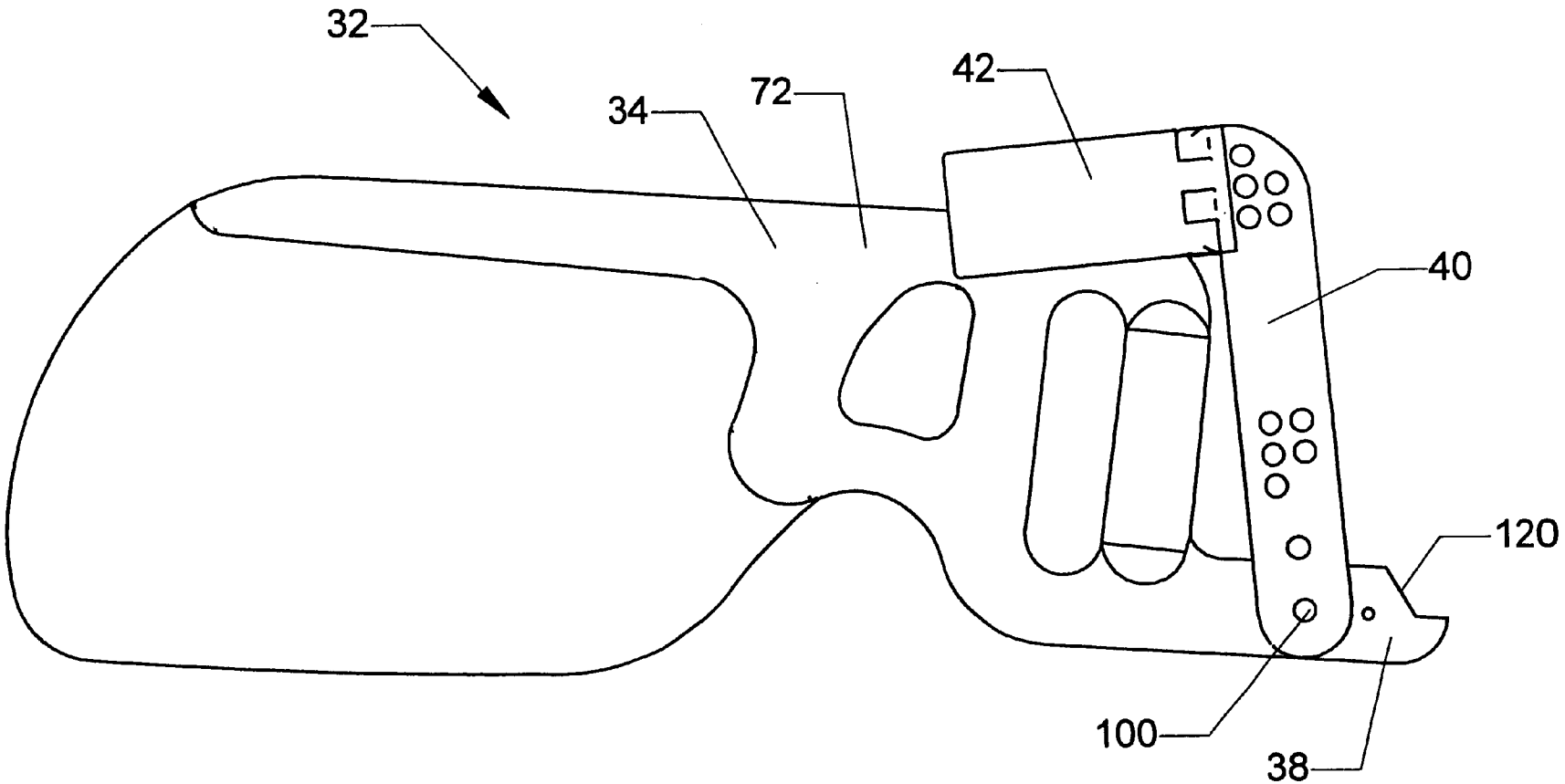
FIG. 5 is a side view of an aquatic propulsion device folded into a storage position.

FIG. 5 shows an aquatic propulsion device 32 folded into a storage position. The storage position reduces overall length to facilitate ease of transportation and/or storage. The elongated forearm member 40 and forearm support 42 may rotate around the rotational attachment screw 100 relative to the forearm member mount 38 and paddle 34. In the folded storage position, the rotation of the elongated forearm member 40 and forearm support 42 is arrested or limited by the paddle's rigidifying support 72.

Figure 6:
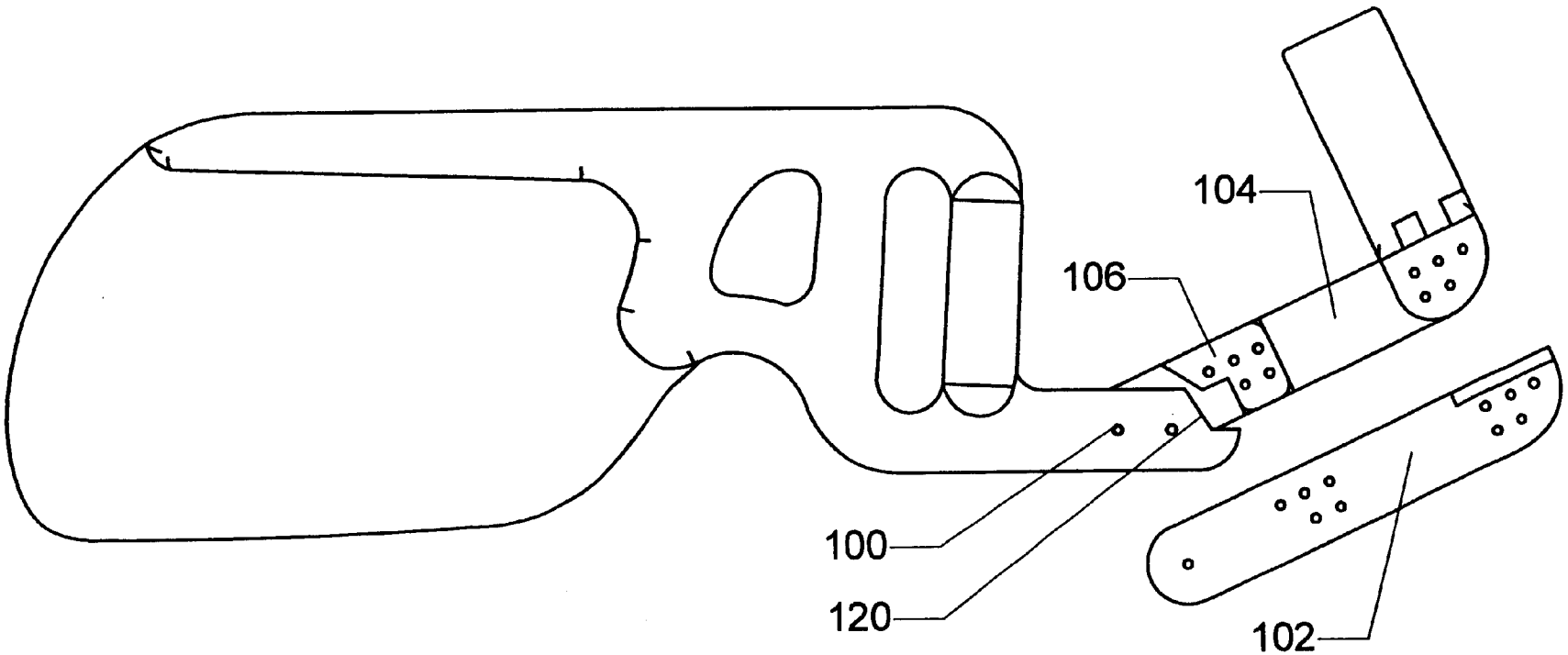
FIG. 6 is a side view showing structural elements that facilitate the folded storage position of FIG. 5.

FIG. 6 shows an aquatic propulsion device in an exemplary partially-folded position, wherein the front elongated member 102 has been removed to expose the structural interaction of the forearm member mount 38 and the rotational stop 106. In a fully extended or usage position, as illustrated in FIGS. 1 through 4, the rotation of the elongated forearm member 40 may be arrested. when the rotational stop 106 contacts a keyed stop 120 of the forearm member mount 38.

Figure 7:
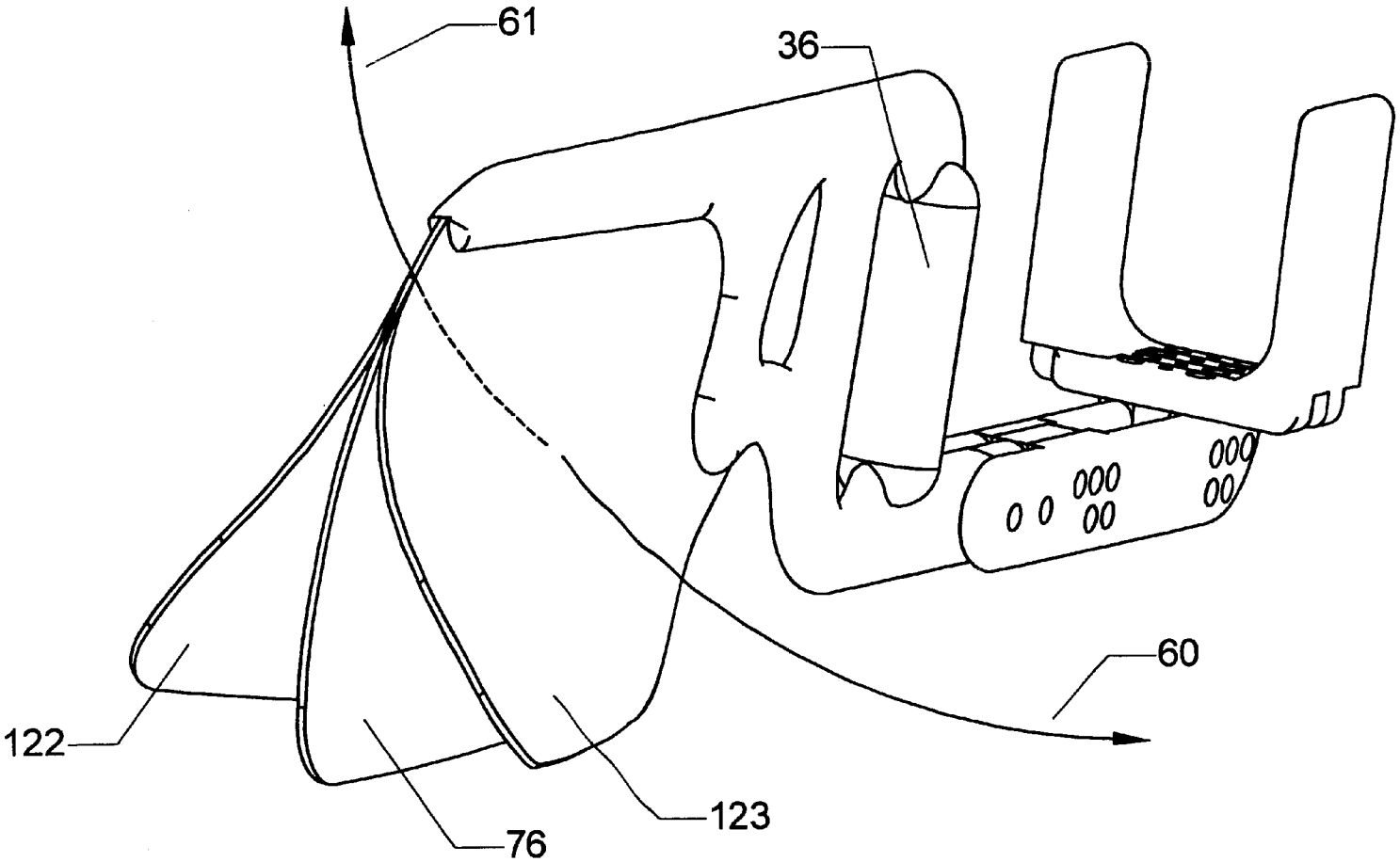
FIG. 7 is a perspective view showing exemplary first, second, and third paddle flex patterns.

FIG. 7 illustrates a first and a second resistive surface flex pattern 122, 123 that result when a person's hand 54 applies a force against the hand grip 36 along a first axis 60 and a second direction, axis, arc or travel path 61 that is generally opposite the first axis 60, respectively. The magnitudes of the first and second flex patterns 122, 123 are dependent on 1) the amount of force applied to the hand grip 36 along the first and second axes 60, 61, respectively; and 2) the rigidity and thickness of the material used to construct the resistive surface 76. As mentioned above, increased flexibility may reduce a novice user's fatigue, while increased rigidity may increase power and control for a more experienced user.

Figure 8A:
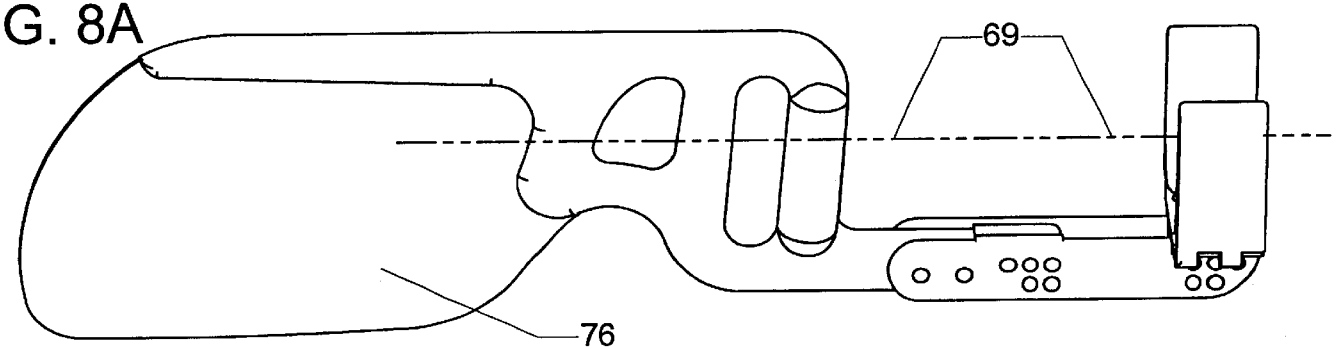
FIGS. 8A, 8B, and 8C are side views respectively showing a first, a second, and a third exemplary rotational orientation of the aquatic propulsion device relative to a user's arm rotation.
Figure 8B:
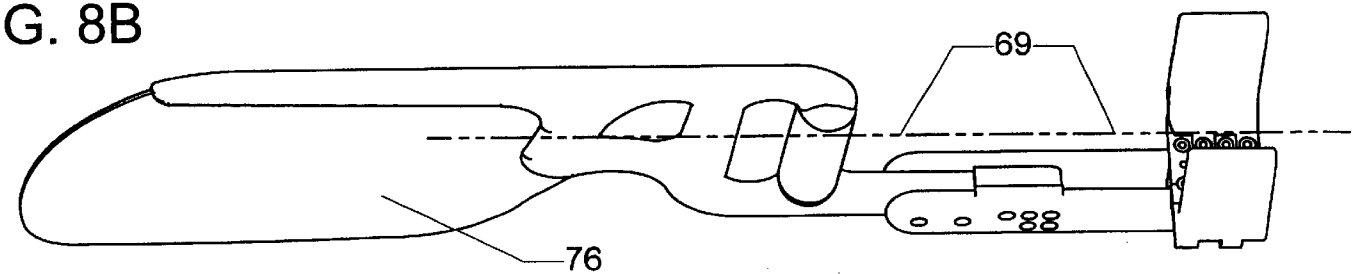
Figure 8C:
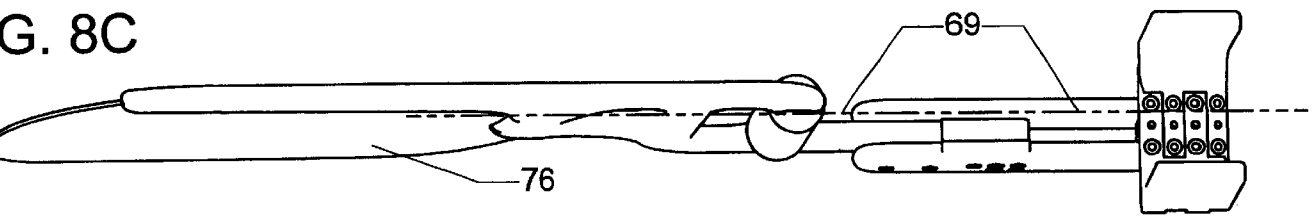

FIGS. 8A, 8B and 8C are side views of an aquatic propulsion device 32 showing various degrees of a rotation orientation around the line 69 running through the hand 54 and the forearm 56. Each of these rotational orientations is exemplified by rotating a user's hand 54 while leaving the forearm 56 and arm 52 in place. One skilled in the art will recognize that the rotational orientations illustrated in FIGS. 8A, 8B and 8C are for descriptive purposes only and represent an essentially infinite range of rotational orientations around the line 69. Rotation of the aquatic propulsion device 32 around the line 69 may be used to 1) steer the aquatic propulsion device during the return or non-power stroke during swimming; and/or 2) adjust the exposure and thereby degree of water displacement by the resistive surface 76 during the power stroke while swimming.

Figure 9:
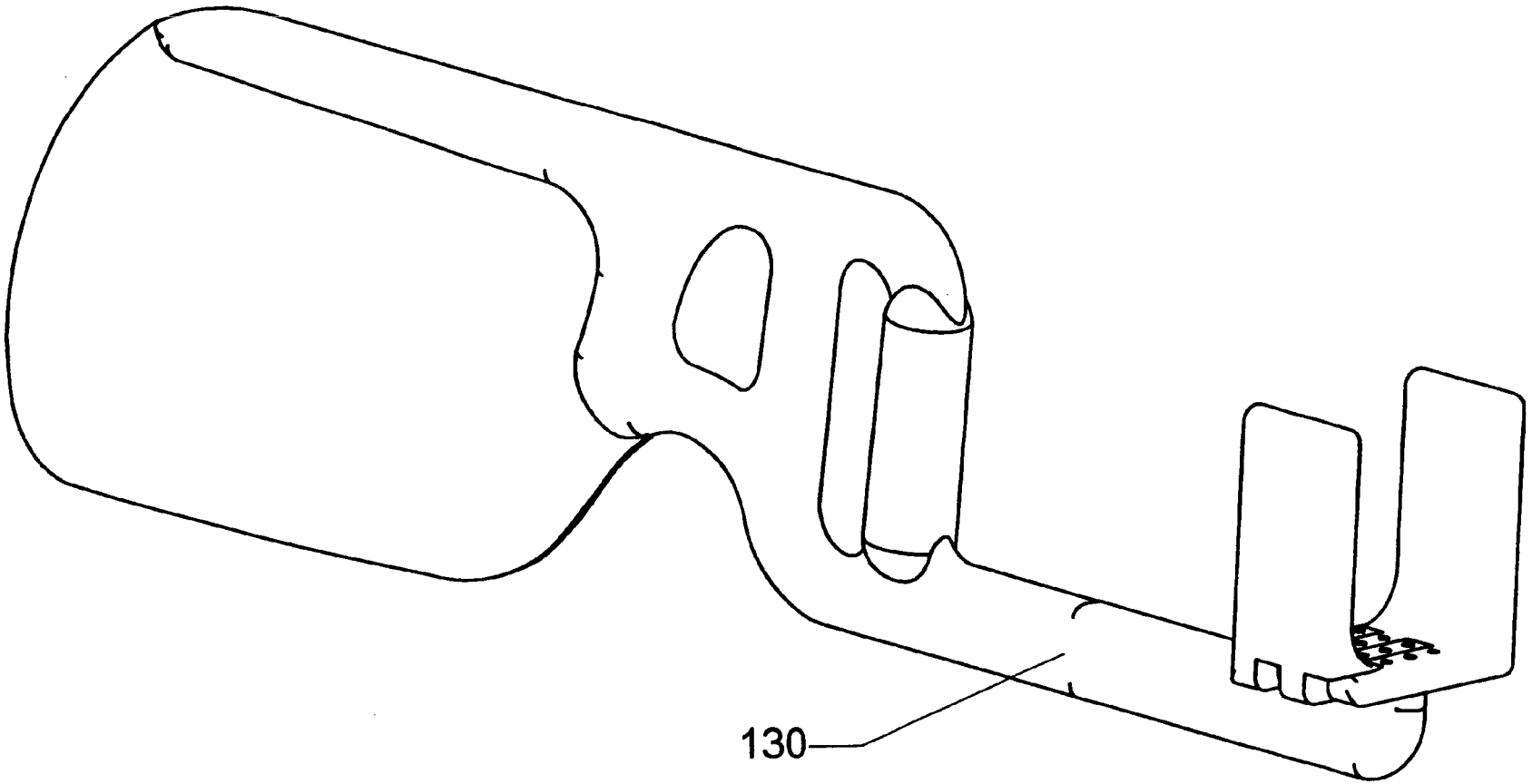
FIG. 9 is a perspective view of a first alternate embodiment of an aquatic propulsion device constructed in accordance with the present invention.

FIG. 9 is an illustration. of an alternate embodiment of an aquatic propulsion device 32 in which the forearm member mount 38 and the elongated forearm member 40 are secured by construction 'as a single rigid forearm member 130. This embodiment simplifies the construction and reduces the amount of material and components required manufacture the aquatic propulsion device 32. Such an embodiment may also improve the hydrodynamic properties of the invention. However, the storage position, as shown in FIG. 5, is not possible in this embodiment. This alternative embodiment may be advantageous for applications where performance and cost outweigh the convenience of the storage position for transportation and storage. One skilled in the art will see that there are any number of embodiments relative to the construction of the elongated member mount 38 and the elongated forearm member 40, including, but not limited to, an embodiment in which they are secured by bolts, latches and/or a telescoping mechanism, thereby providing some of the advantages of the single rigid forearm member 130 while allowing for detachment to facilitate transportation and/or storage.

Figure 10:
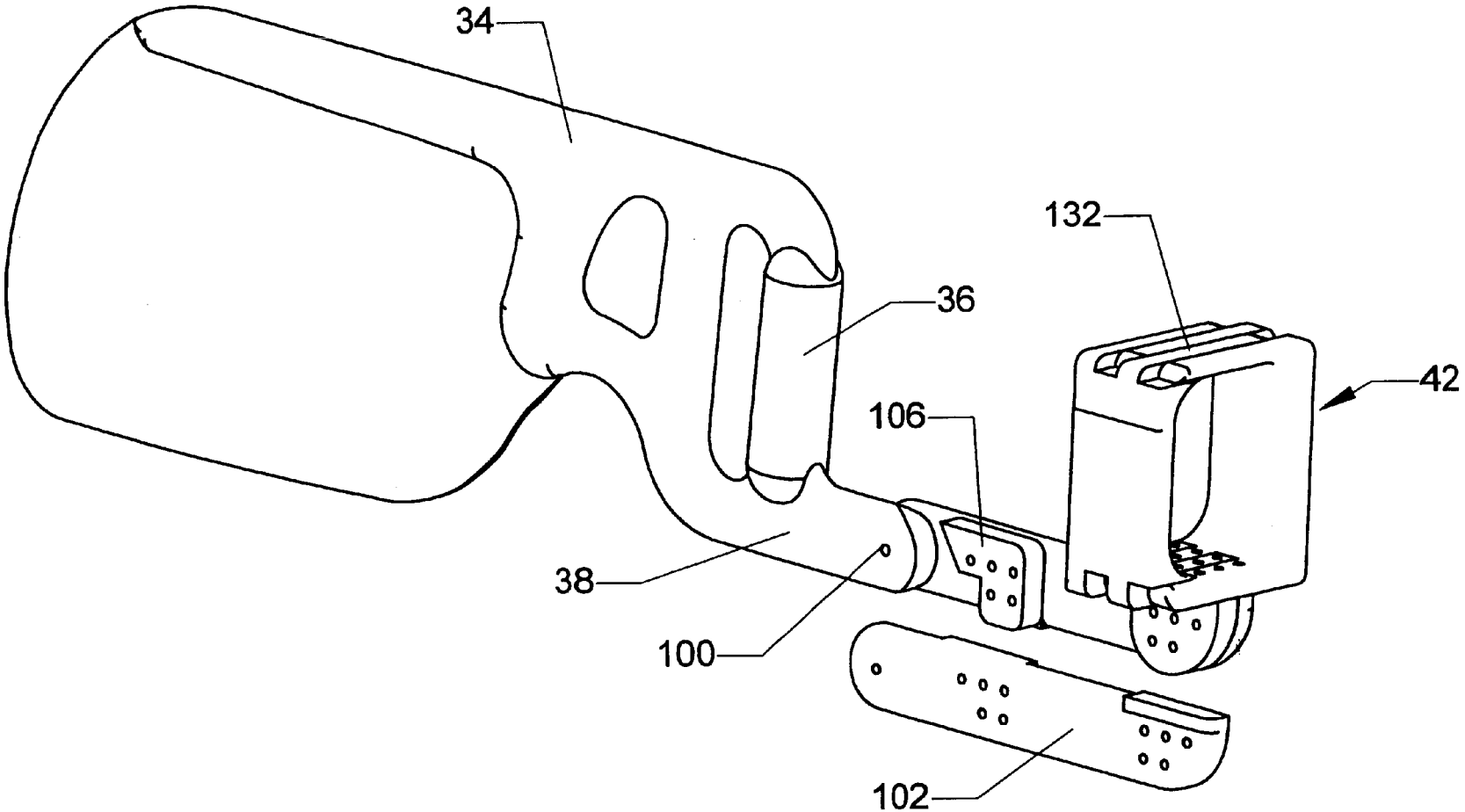
FIG. 10 is a perspective view of a second alternate embodiment of an aquatic propulsion device constructed in accordance with the present invention.
Figure 11:
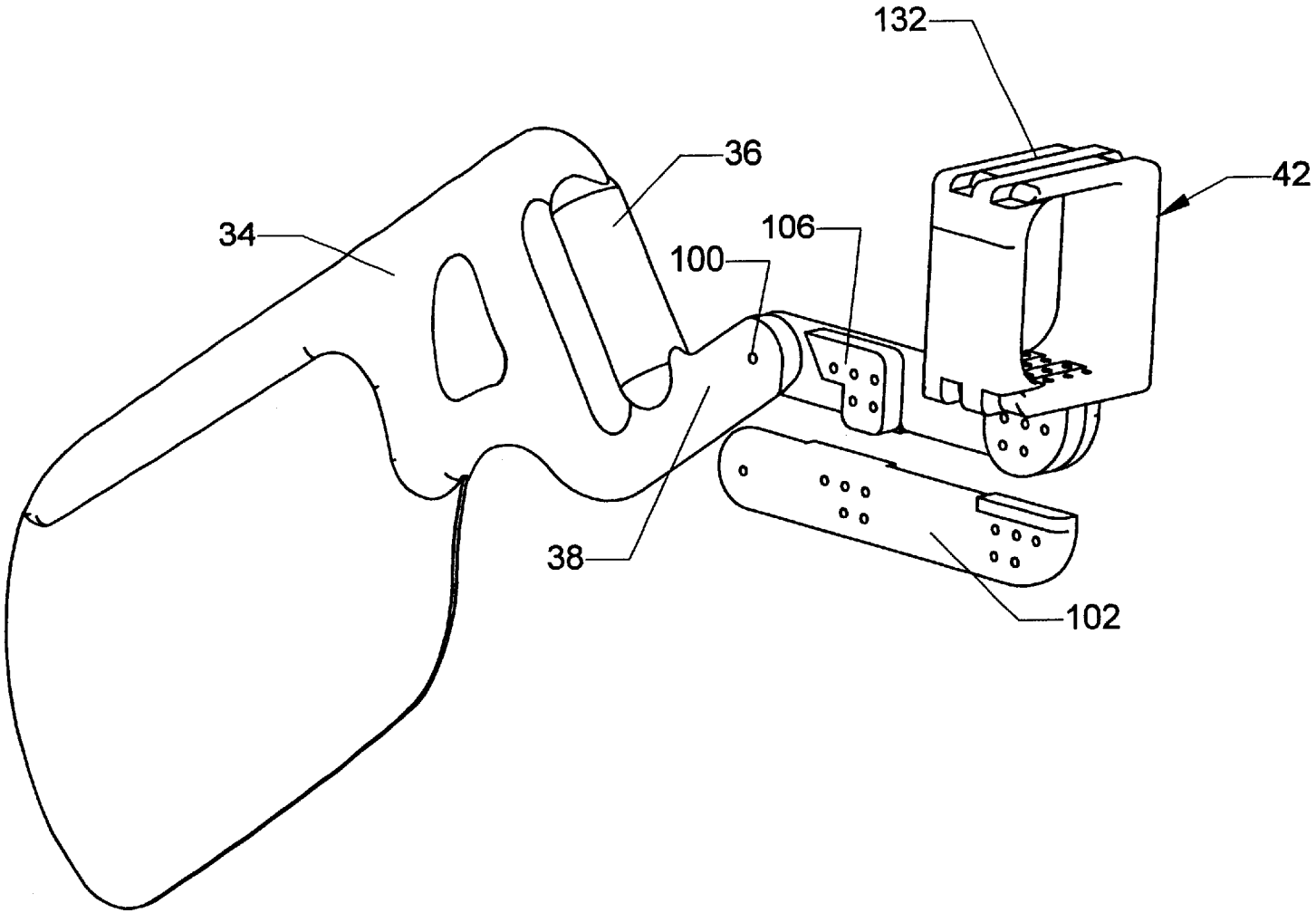
FIG. 11 is a perspective view showing structural elements that facilitate a disengaged position for the aquatic propulsion device of FIG. 10.

FIGS. 10 and 11 illustrate another embodiment of the present invention in which the forearm support 42 includes a support top 132 to facilitate a full encircling of the forearm 56. For purpose of example, the front elongated member 102 has been removed in FIGS. 10 and 11 to expose the structural interaction of the forearm member mount 38 and the rotational stop 106. As can be seen in FIGS. 10 and 11, the forearm member mount 38 may rotate around the rotational attachment screw 100 unencumbered by the rotational stop 106, thereby allowing the forearm member mount 38 and paddle 34 to swing out of the way of the hand 54 when the hand grip 36 is released. In such an embodiment, the tether 84, as shown in FIGS. 3 and 4, is not necessary because when released, the aquatic propulsion device 32 is prevented from drifting, floating, sinking or otherwise undesirably moving away from the person 30 by the forearm support 42. This embodiment may be advantageous when unimpeded movement of the forearm 56 and arm 52 are not required. Those skilled in the art will understand that in yet another embodiment, one or more portions of the forearm support 42 could comprise a strap, which may be implemented, for example, using Velcro™ or other material.

Figure 12:
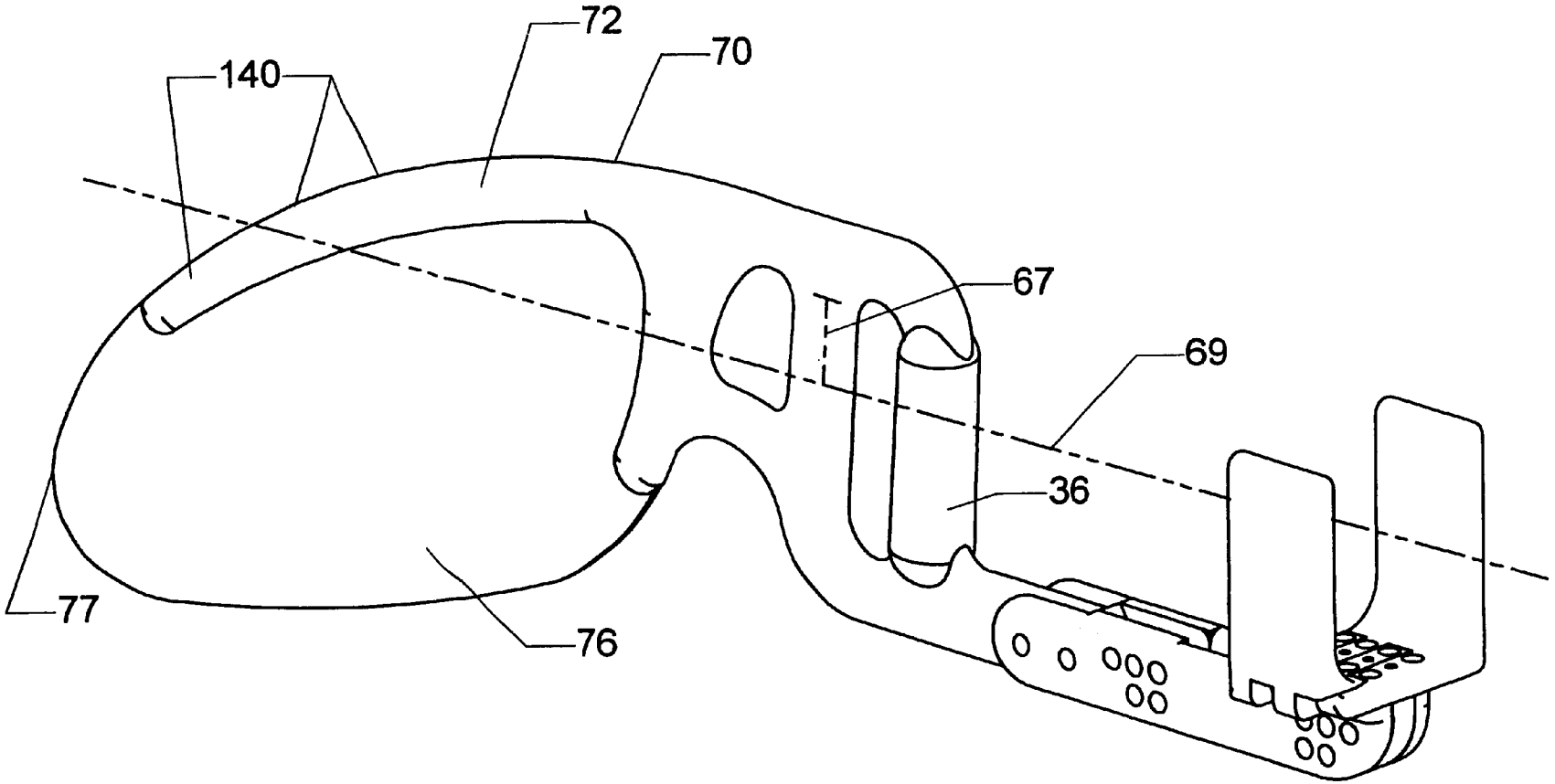
FIG. 12 is a perspective view showing a third alternate embodiment of an aquatic propulsion device constructed in accordance with the present invention.

FIG. 12 illustrates an embodiment of an aquatic propulsion device 32, as taught by the present invention, wherein the leading edge 70, rigidifying support 72 and the resistive surface 76 have or include a downward taper 140 on an end opposing the hand grip 36. The downward taper 140 curves down and past the line 69 running through the hand 54 and the forearm 56; that is, the downward taper 140 curves toward a line essentially parallel to the elongated forearm member 40. The downward taper 140 significantly reduces an average or effective steering radius 67, defined as an average distance between the line 69 and the leading edge 70, thereby increasing control and reducing the torque required to make directional adjustment to the paddle 34 through the water on the return or non-power stroke while swimming. In an exemplary embodiment, the effective steering radius 67 is approximately one inch; and the downward taper 140 curves such that the vertical distance or offset between the leading edge 70 and a tip or end 77 of the paddle's resistive surface 76 is approximately four inches. Those skilled in the art will recognize that the effective steering radius 67 and the extent of the downward taper 140 may vary in accordance with particular embodiment details.

Figure 13:
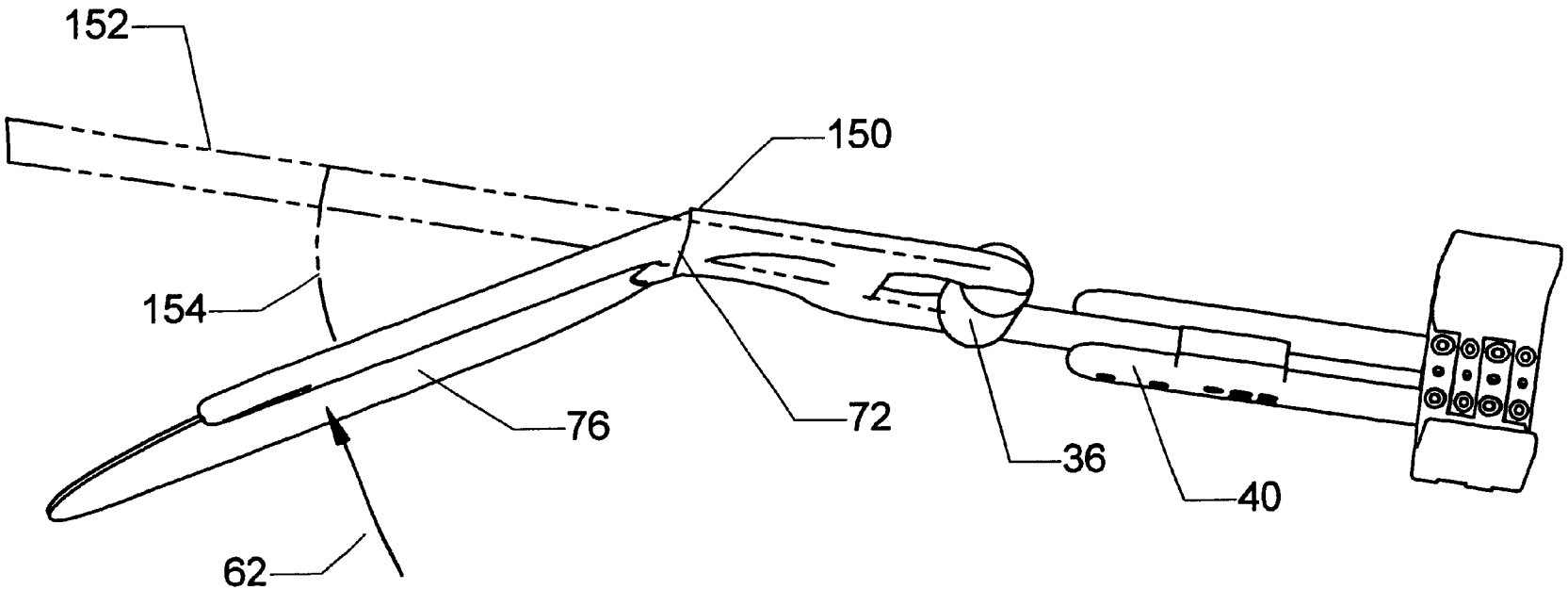
FIG. 13 is a perspective view showing a fourth alternate embodiment of an aquatic propulsion device constructed in accordance with the present invention.

FIG. 13 illustrates yet another embodiment of the present invention, in which a bend 150 is formed in the rigidifying support 72, thereby moving the resistive surface 76 out of a plane 152 formed by opposing ends of the hand grip 36 and the length of the elongated forearm member 40. The bend 150 may be characterized by an angle 154 formed between the resistive surface 76 and the plane 152. The angle 154 modifies the exposure of the resistive surface 76 to the water relative to the movement of the arm 52 during a power stroke while swimming. Various degrees of angle 154 may be advantageous for redirecting the resistive force 62 of the resistive surface 76 against the water in a more forward direction during a strongest portion of the arm's movement while swimming. This in turn may improve or enhance the aquatic propulsion properties of the present invention. In an exemplary embodiment, the angle 154 is approximately 15 degrees. Those skilled in the art will see that many different angles may be advantageous depending upon 1) the swimming application, such as, speed, distance, sport, or recreational use; and/or 2) the skill of the user. Those skilled in the art will also understand that an embodiment that incorporates the bend 150 may also incorporate the downward taper 140 shown in FIG. 12.

While certain exemplary embodiments have -been described and shown in the accompanying drawings, it is to be understood that such embodiments are merely illustrative and not restrictive of the current invention, and that elements of said embodiments may be combined in part or whole, and that this invention is not restricted to the specific constructions and arrangements shown and described since a wide range of modifications may occur by those ordinarily skilled in the art. The description herein provides for such modifications, and is limited only by the following claims.

What is claimed is:

1. An aquatic propulsion device comprising:

a forearm support to be worn on a forearm of a person;

an elongate member having a first end secured to the forearm support; and a paddle secured to a second end of the elongate member, a combination of the elongate member and the paddle having a grip positioned so that a person, when placing the forearm in the forearm support, can reach and hold onto the grip with a hand and move the grip with the hand such that the forearm support, the elongate member and the paddle move in tandem with the hand and the forearm, wherein a combination of the forearm support, the elongate member, the grip, and the paddle is characterized by a center of water displacement extending beyond the hand-away from the forearm, and wherein the paddle is asymmetric with respect to a line extending along the forearm toward the hand that divides the forearm into two generally equal portions.

2. The aquatic propulsion device of claim 1, wherein the paddle comprises:

a rigidifying support, a portion of the rigidifying support extending along a line essentially perpendicular to the grip; and a resistive surface secured to the rigidifying support.

3. The aquatic propulsion device of claim 2, wherein a portion of the rigidifying support forms a leading edge that is substantially inline with the hand and forearm.

4. The aquatic propulsion device of claim 2, wherein a portion of the rigidifying support is tapered toward a line parallel to the elongate member.

5. The aquatic propulsion device of claim 2, wherein a portion of the rigidifying support includes a bend that situates the resistive surface in a first plane that intersects a second plane formed by opposing ends of the grip and the length of the elongated member.

6. The aquatic propulsion device of claim 2, wherein the resistive surface comprises a flexible material.

7. The aquatic propulsion device of claim 2, wherein the paddle includes a recessed portion between the grip and the resistive surface.

8. The aquatic propulsion device of claim 1, wherein the paddle includes an opening proximate the grip.

9. The aquatic propulsion device of claim 1, wherein the forearm support comprises material forming a generally u-shaped opening.

10. The aquatic propulsion device of claim 1, wherein the forearm support encloses the forearm.

11. The aquatic propulsion device of claim 1, wherein the elongate member may partially rotate relative to the paddle.

12. The aquatic propulsion device of claim 1, wherein the device is characterized by one from the group of a neutral buoyancy and a slightly negative buoyancy.

13. The aquatic propulsion device of claim 1, wherein the forearm support is adjustable to accommodate a range of forearm widths.

14. The aquatic propulsion device of claim 1, wherein the elongate member is adjustable to accommodate a range of forearm lengths.

15. An aquatic propulsion device comprising:

a forearm support to be worn on a forearm of a person;

an elongate member having a first end secured to the forearm support; and a paddle secured to a second end of the elongate member, a combination of the elongate member and the paddle having a grip positioned so that a person, when placing the forearm in the forearm support, can reach and hold onto the grip with a hand and move the grip with the hand such that the forearm support, the elongate member and the paddle move in tandem with the hand and the forearm, wherein an average distance that the paddle perpendicularly extends away from the elongate member on a thumb side of the hand is less than an average distance that the paddle perpendicularly extends away from the elongate member opposite the thumb side of the hand.

16. An aquatic propulsion device comprising:

a forearm support to be worn on a forearm of a person;

an elongate member having a first end secured to the forearm support; and a paddle secured to a second end of the elongate member, a combination of the elongate member and the paddle having a grip positioned so that a person, when placing the forearm in the forearm support, can reach and hold onto the grip with a hand and move the grip with the hand such that the forearm support, the elongate member and the paddle move in tandem with the hand and the forearm, wherein the paddle is tapered along a substantial portion of its length toward the elongate member, in a plane in which the paddle and the grip reside and which generally bisects the forearm support.

17. A method for enhancing a swimmer's propulsion in water, the swimmer having at least one forearm and at least one hand, the method utilizing at least one aquatic propulsion device, each aquatic propulsion device comprising an elongate member having a first end and a second end, a forearm support secured to the first end of the elongate member, a paddle secured to a second end of the elongate member, and a hand grip secured to the paddle, the method comprising the steps of:

(a) positioning a forearm in a forearm support of an aquatic propulsion device;

(b) holding a hand grip of the aquatic propulsion device with a hand corresponding to the forearm positioned in the forearm support;

(c) performing a propulsive stroke by moving the aquatic propulsion device along a first arc while maintaining the paddle generally perpendicular to a substantial portion of the first arc;

(d) rotating the hand and forearm to orient the aquatic propulsion device in a rotated position;

(e) performing a return stroke by moving the aquatic propulsion device along a second arc while generally maintaining the aquatic propulsion enhancement device in the rotated position such that the paddle remains generally parallel to a substantial portion of the second arc.

* * * * *